US008205476B2

(12) United States Patent
Voice

(10) Patent No.: US 8,205,476 B2
(45) Date of Patent: Jun. 26, 2012

(54) SHAPE CORRECTING COMPONENTS

(75) Inventor: Wayne E. Voice, Nottingham (GB)

(73) Assignee: Rolls-Royce PLC, London (GB)

( * ) Notice: Subject to any disclaimer, the term of this patent is extended or adjusted under 35 U.S.C. 154(b) by 957 days.

(21) Appl. No.: 12/232,239

(22) Filed: Sep. 12, 2008

(65) Prior Publication Data

US 2009/0102095 A1 Apr. 23, 2009

(30) Foreign Application Priority Data

Oct. 12, 2007 (GB) ..... 0719873.2

(51) Int. Cl.
*B21D 31/00* (2006.01)
*B21D 53/78* (2006.01)

(52) U.S. Cl. ..... 72/364; 72/60; 72/342.1; 72/700; 29/889.7

(58) Field of Classification Search ..... 72/57, 60, 72/63, 342.1, 342.5, 342.6, 342.7, 342.8, 72/342.94, 364, 700, 54, 56; 29/889.7
See application file for complete search history.

(56) References Cited

U.S. PATENT DOCUMENTS

| | | | | |
|---|---|---|---|---|
| 3,739,617 | A * | 6/1973 | Stejskal | 72/63 |
| 4,021,910 | A * | 5/1977 | Freeman et al. | 29/526.2 |
| 4,087,996 | A * | 5/1978 | Paille | 72/38 |
| 4,188,811 | A | 2/1980 | Brimm | |
| 4,250,610 | A * | 2/1981 | Wilbers et al. | 29/424 |
| 4,612,066 | A * | 9/1986 | Levin et al. | 148/669 |
| 4,985,379 | A * | 1/1991 | Egerton et al. | 501/104 |
| 5,063,662 | A * | 11/1991 | Porter et al. | 148/671 |
| 5,154,882 | A * | 10/1992 | Zick | 419/49 |
| 5,190,603 | A | 3/1993 | Nazmy et al. | |
| 5,350,637 | A * | 9/1994 | Ketcham et al. | 428/539.5 |
| 5,394,933 | A * | 3/1995 | Takayanagi | 164/369 |
| 5,545,265 | A * | 8/1996 | Austin et al. | 148/421 |
| 5,609,698 | A | 3/1997 | Kelly et al. | |
| 5,762,731 | A | 6/1998 | Dodd | |
| 5,816,090 | A * | 10/1998 | Hodge et al. | 72/56 |
| 5,997,273 | A * | 12/1999 | Laquer | 425/394 |
| 6,264,771 | B1 * | 7/2001 | Bornschlegl et al. | 148/710 |
| 6,408,512 | B1 | 6/2002 | Boegli et al. | |
| 6,521,059 | B1 | 2/2003 | Nazmy et al. | |
| 6,673,169 | B1 * | 1/2004 | Peterson et al. | 148/524 |
| 6,702,886 | B2 * | 3/2004 | Whittle et al. | 106/38.27 |
| 2006/0230807 | A1 * | 10/2006 | Shultz et al. | 72/364 |

(Continued)

FOREIGN PATENT DOCUMENTS

DE 2119019 * 11/1971

(Continued)

OTHER PUBLICATIONS

Lapin, "Creep behaviour of a cast TiAl-based alloy for industrial applications," *Intermetallics*, vol. 14, 2006, pp. 115-122.

(Continued)

*Primary Examiner* — Edward Tolan
(74) *Attorney, Agent, or Firm* — Oliff & Berridge, PLC

(57) ABSTRACT

A method of correcting the shape of a brittle cast component such as a low pressure turbine blade. The method includes steps of placing the component against a creep mold having a surface defining the desired profile of the component and HIP treating it to creep deform the component to the desired shape whilst consolidating it and removing gas and shrinkage porosity.

8 Claims, 2 Drawing Sheets

U.S. PATENT DOCUMENTS

| | | | |
|---|---|---|---|
| 2006/0272380 | A1 | 12/2006 | Storsberg et al. |

FOREIGN PATENT DOCUMENTS

| | | | |
|---|---|---|---|
| DE | 199 25 781 | A1 | 12/2000 |
| DE | 102 44 338 | A1 | 4/2004 |
| DE | 10 2005 023 732 | B3 | 7/2006 |
| EP | 1 813 691 | A1 | 8/2007 |
| GB | 2 094 691 | A | 9/1982 |
| GB | 2 293 629 | A | 4/1996 |
| GB | 2 350 573 | A | 12/2000 |
| JP | A-61-1422 | | 1/1986 |
| SU | 624683 | | 8/1978 |

OTHER PUBLICATIONS

Nicolai et al., "Investment Casting of Titanium," *Titanium and Titanium Alloys: Fundamentals and Applications*, 2003, pp. 263-271.

* cited by examiner

SHAPE CORRECTING COMPONENTS

The present invention relates to correcting and setting the shape of cast components. It is particularly, though not exclusively, concerned with correcting the shape of brittle, expensive components that require a high level of precision.

A gas turbine engine, as shown in FIG. 1, comprises an air intake 12 and a propulsive fan 14 that generates two airflows A and B. The gas turbine engine 10 comprises, in axial flow A, an intermediate pressure compressor 16, a high pressure compressor 18, a combustor 20, a high pressure turbine 22, an intermediate pressure turbine 24, a low pressure turbine 26 and an exhaust nozzle 28. A nacelle 30 surrounds the gas turbine engine 10 and defines, in axial flow B, a bypass duct 32.

Typically the blades of the low pressure turbine 26 are cast from nickel alloys. Casting does not always result in a perfectly formed component and thus some correction of the shape is required. This can be performed relatively easily and cheaply by mechanical plastic deformation. However, there is a requirement to replace nickel alloys with intermetallics such as titanium aluminide alloys to reduce the weight of the low pressure turbine without compromising the strength of the blades. Gamma titanium aluminide (γ-TiAl) is a desirable alloy for low pressure turbine blades. However, it is a relatively brittle material and therefore cannot be deformed using mechanical plastic deformation.

One disadvantage of this alloy is that low pressure turbine blades cast from intermetallics such as γ-TiAl must either suffer very low yield, due to the blade being imperfectly shaped, or must be cast oversize and then machined to the desired shape. In either case this is expensive, time consuming and wasteful.

The present invention seeks to provide a method of forming a perfectly shaped component that seeks to address the aforementioned problems.

Accordingly the present invention provides a method of forming a component comprising the steps of casting a component; placing the component adjacent a mould surface; and creep deforming the component during the application of heat and pressure to conform at least a part thereof to the mould surface.

Preferably the component comprises titanium aluminide alloy, forms of silicide based on niobium or molybdenum, or ceramic.

Preferably the applied pressure comprises isostatic pressure. More preferably the hot isostatic pressure is applied via a secondary particulate material.

Preferably the component and mould surface are wrapped in a foil to prevent infiltration between the component and mould surface by the secondary particulate material. More preferably the foil is yttria coated.

Preferably the component is a turbine blade for a gas turbine engine. More preferably the component is a low pressure turbine blade.

Preferably the creep mould is ceramic. More preferably the creep mould comprises yttria face coated alumina or silica.

Preferably the component is cast in a net-shape mould.

The present invention will be more fully described by way of example with reference to the accompanying drawings, in which.

Figure 1:
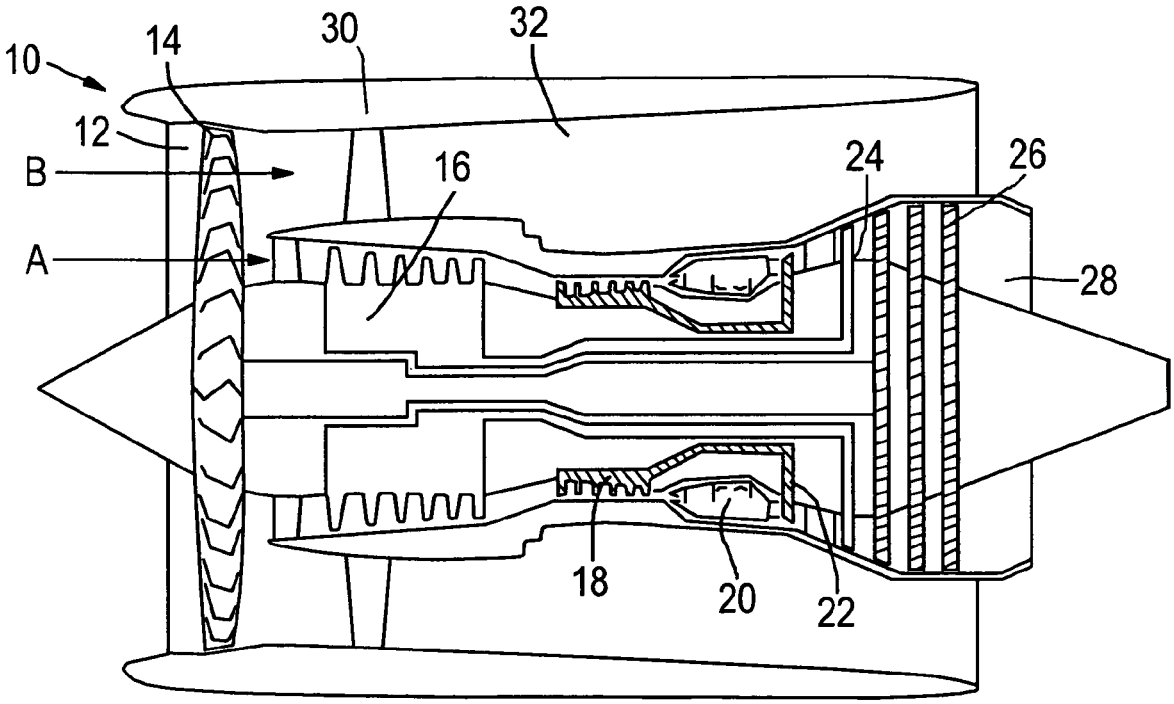
FIG. 1 is a sectional side view of a gas turbine engine.

The method of the present invention is described with reference to the first embodiment shown in FIG. 2 and FIG. 3. In a first step of the method, a turbine blade 34 is cast from γ-TiAl in a net-shape mould. This results in a blade 34 that is close to the desired shape and usually contains internal gas and shrinkage porosity.

In a second step of the method of the present invention, the turbine blade 34, having a pressure surface 36 and a suction surface 38, is placed onto a creep mould 40 having a mould surface 42 that defines the desired shape of the pressure surface 36 of the turbine blade 34. The pressure surface 36 of the blade 34 is placed against, but does not exactly conform to, the mould surface 42 of the creep mould 40, as is shown in FIG. 2. It does not exactly conform due to the imperfect shape of the cast turbine blade 34. The turbine blade 34 and the creep mould 40 are preferably wrapped in an inert foil 43, such as mild steel foil. To avoid contamination of the blade 34 by the foil 43, a releasing agent such as a thin yttria coating may be used.

The creep mould 40 is preferably a ceramic component so that it is unaffected by the heat supplied thereto in a later step of the method. Preferably, the ceramic is yttria face coated alumina or silica, which is similar to the material used to form casting moulds.

In a third step of the method, the arrangement 44, comprising the turbine blade 34, the creep mould 40 and the foil 43, is placed inside a canister comprising a deformable wall inside a hot isostatic pressure (HIP) chamber. Between the deformable wall and the arrangement 44 inside is a solid particulate material that can transfer heat and isostatic pressure from supply means located externally of the deformable wall to the arrangement 44. The foil wrapping 43 prevents the solid particulate material infiltrating the gap between the turbine blade 34 and the creep mould 40. Typically the isostatic pressure is applied to the deformable wall by argon gas impingement, which can also be heated, but other known methods can be used with equal felicity.

In a fourth step of the method, heat and isostatic pressure are applied to the canister inside the HIP chamber to consolidate the component and close all porosities. During the application of heat and isostatic pressure in the HIP chamber the turbine blade 34 also deforms through the mechanism of creep. Since the creep mould 40 retains its shape throughout the HIP process, the turbine blade 34 deforms under its own weight so that its pressure surface 36 conforms to the shape of the mould surface 42 of the creep mould 40 as shown in FIG. 3. The arrangement 44 is then removed from the HIP chamber and the canister and the turbine blade 34 can be removed from the creep mould 40. Typically the turbine blade 34 requires further processing, for example the addition of cooling holes, as is well known in the art.

Hence, this method provides a turbine blade 34 that is fully consolidated and has the desired shape. This substantially reduces or eliminates the waste associated with a need to scrap imperfectly shaped blades 34 or to cast an oversize component and machine away waste material until the desired shape and size is obtained.

Figure 2:
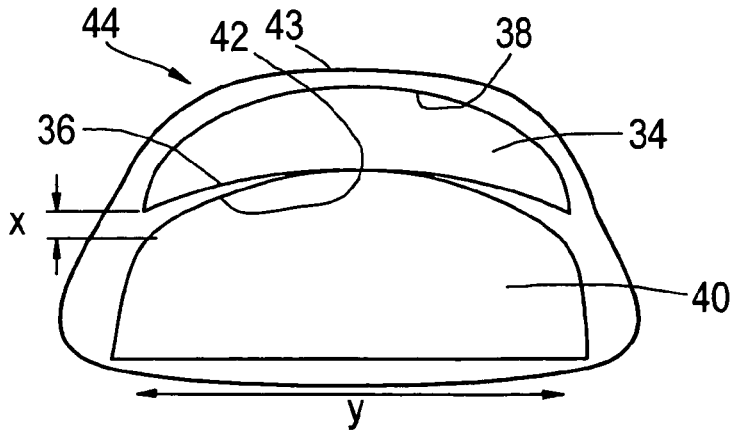
FIG. 2 and FIG. 3 are schematic side views of a component before and after creep deformation according to a first embodiment of the present invention.
Figure 3:
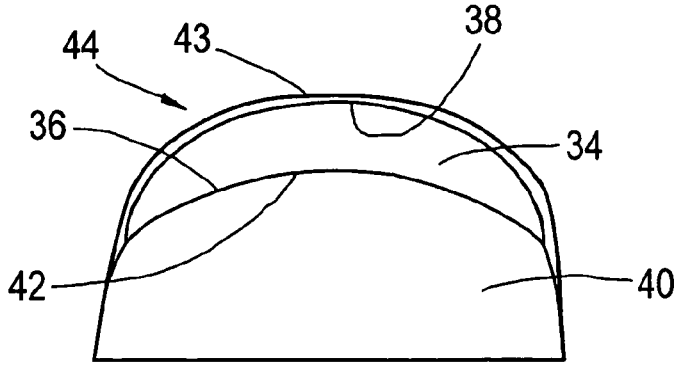

A typical turbine blade 34 is around 400 mm long, indicated by arrows y in FIG. 2. The furthest distance between the pressure surface 36 of the turbine blade 34 and the mould surface 42 of the creep mould 40 is typically a few millimetres, up to around 10 mm and indicated by arrows x. Thus the method of the present invention is able to correct the shape of a cast γ-TiAl turbine blade 34 by around 10 mm during the HIP step.

Figure 4:
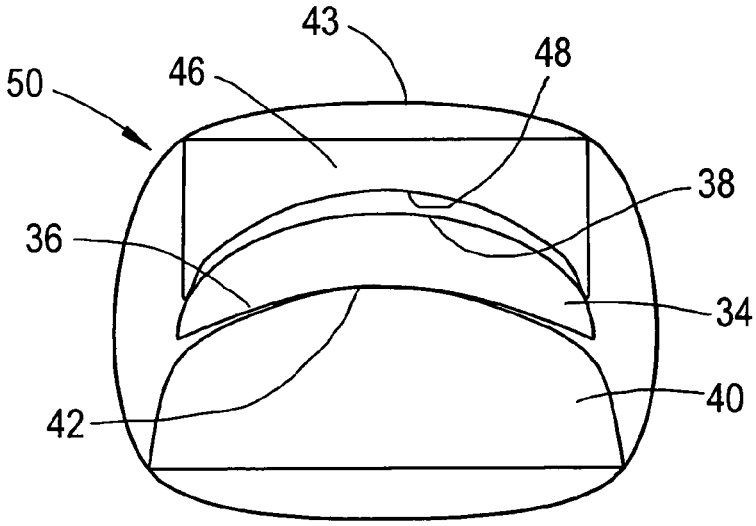
FIG. 4 and FIG. 5 are schematic side views of a component before and after creep deformation according to a second embodiment of the present invention.
Figure 5:
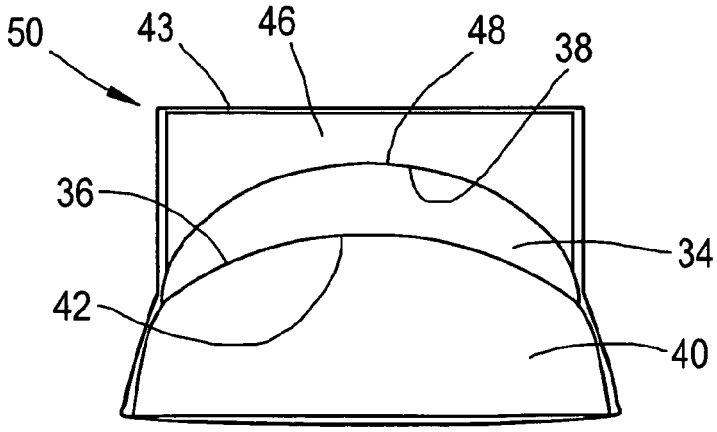

A second embodiment of the present invention is shown in FIG. 4 and FIG. 5 in which like reference numerals are used for like components. As in the first embodiment described above, a turbine blade 34 having pressure 36 and suction 38 surfaces is placed onto a first creep mould 40 so that the pressure surface 36 of the blade 34 is adjacent to the mould surface 42 of the first creep mould 40. A second creep mould 46, having a mould surface 48 defining the desired shape of the suction surface 38 of the turbine blade 34, is placed onto the turbine blade 34 so that the mould surface 48 thereof is adjacent to the suction surface 38 of the turbine blade 34. As with the first embodiment, the turbine blade 34 and creep moulds 40, 46 are preferably wrapped in an inert foil 43 such as mild steel foil.

The arrangement 50, comprising the turbine blade 34 and the first and second creep moulds 40, 46, is placed inside a canister within a HIP chamber as described with respect to the first embodiment. Heat and isostatic pressure are applied to the canister inside the HIP chamber, preferably by heated argon gas, to consolidate the blade 34 and to close the porosities. The combined weight of the blade 34 and the second (upper) creep mould 46 also causes the turbine blade 34 to creep. The first and second creep moulds 40, 46 constrain the blade 34 to deform during creep to conform to the shape of the adjacent creep mould. Hence, the turbine blade 34 creeps to the shape shown in FIG. 5.

The arrangement 50 can be removed from the canister and the HIP chamber and the turbine blade 34 extracted from between the creep moulds 40, 46. Further processing may be required as discussed in relation to the first embodiment.

Although the method of the present invention has been described with respect to the shape correction and setting of a turbine blade 34, it may be applied to other components of a gas turbine engine, for example low pressure turbine stators and high pressure compressor stators and blades.

Although the canister has been described with a deformable wall surrounding a solid particulate material for transferring the heat and isostatic pressure, other known methods of HIP treating a component could be employed. For example, direct application of heat and isostatic pressure to a sealed foil assembly, although this has been found to be less efficacious than the indirect method described above.

Although the isostatic pressure applied to the deformable wall is described as via argon gas impingement, which can also be heated, other known methods can be used with equal felicity.

Although creep setting of intermetallics such as γ-TiAl has been described, the method of the present invention can also be used with other brittle materials such as ceramics and forms of silicide based on niobium or molybdenum. Such materials could be used for components in hotter parts of a gas turbine engine or in other applications.

I claim:

1. A method of forming a component comprising the steps of:

a) casting a component comprising titanium aluminide alloy, forms of silicide based on niobium or molybdenum, or ceramic;

b) placing the component adjacent a mould surface comprising yttria face coated alumina or silica; and c) creep deforming the component during the simultaneous application of heat and isostatic pressure to simultaneously consolidate the component and conform at least a part thereof to the mould surface.

2. A method as claimed in claim 1 wherein the simultaneous application of hot isostatic pressure is applied via a secondary particulate material.

3. A method as claimed in claim 2 wherein the component and mould surface are wrapped in a foil to prevent infiltration between the component and mould surface by the secondary particulate material.

4. A method as claimed in claim 3 wherein the foil is yttria coated.

5. A method as claimed in claim 1 wherein the component is a turbine blade for a gas turbine engine.

6. A method as claimed in claim 5 wherein the component is a low pressure turbine blade.

7. A method as claimed in claim 1 wherein the creep mould is ceramic.

8. A method as claimed in claim 1 wherein the component is cast in a net-shape mould.

* * * * *